109-49.5 SR
12/1/87 XR 4,709,659

United States Patent [19]
Quante, III et al.

[11] Patent Number: 4,709,659
[45] Date of Patent: Dec. 1, 1987

[54] BALLISTIC AND FORCED ENTRY RESISTANT BARRIER

[75] Inventors: Jeffrey B. Quante, III; Steven C. Scoggin; Dennis L. Maxwell, all of Montgomery; Marvin W. Rosenkoetter, Elmore; James J. Ferencik, Prattville, all of Ala.

[73] Assignee: Norment Industries, Inc., Montgomery, Ala.

[21] Appl. No.: 781,783

[22] Filed: Sep. 30, 1985

[51] Int. Cl.[4] ..... E06B 7/30
[52] U.S. Cl. ..... 109/21.5; 52/473; 109/10; 109/49.5
[58] Field of Search ..... 52/473; 98/121.1; 55/486; 109/49.5, 10, 21.5

[56] References Cited

U.S. PATENT DOCUMENTS

| | | | |
|---|---|---|---|
| 547,356 | 10/1895 | Pancoast | 98/121.1 |
| 1,218,684 | 3/1917 | Mitchell | 98/121.1 |
| 1,272,202 | 7/1918 | Bradley | 98/121.1 |
| 1,899,735 | 2/1933 | McClintock | 109/10 |
| 1,953,708 | 4/1934 | Fuller | 109/21.5 |
| 1,977,719 | 10/1934 | Forsell | 109/10 |
| 1,995,819 | 3/1935 | Rogers | 109/10 |
| 2,392,215 | 1/1946 | Abrams et al. | 109/85 |
| 2,424,219 | 3/1944 | Black | 98/121.1 |
| 2,459,983 | 1/1949 | Werner et al. | 98/121.1 |
| 3,749,028 | 7/1973 | Strobl | 109/21.5 |
| 3,995,566 | 12/1976 | Strobl | 109/21.5 |
| 4,078,477 | 3/1978 | Sommer | 98/121.1 |

FOREIGN PATENT DOCUMENTS

| | | | |
|---|---|---|---|
| 593408 | 2/1934 | Fed. Rep. of Germany | 98/121.1 |
| 1116886 | 9/1957 | Fed. Rep. of Germany | 109/10 |
| 1659891 | 10/1969 | Fed. Rep. of Germany | 109/10 |
| 14017 | of 1890 | United Kingdom | 98/121.1 |

*Primary Examiner*—William F. Pate, III
*Assistant Examiner*—Caroline D. Dennison
*Attorney, Agent, or Firm*—Banner, Birch, McKie and Beckett

[57] ABSTRACT

The present invention is directed to a forced entry and ballistic resistant barrier comprising a plurality of adjacent segments securely and rigidly affixed to each other. Each segment includes a first pair of longitudinally elongated C-shaped channels whose concave sides are diametrically opposed about a flat bar positioned therebetween. In addition to the first pair of C-shaped channels, each segment preferably comprises a second pair of longitudinally elongated C-shaped channels, larger than the first pair, positioned concentrically about the first pair such that one channel of the second pair overlaps a convex portion of one channel of the first pair; the other channel of the second pair overlaps a complementary convex portion of the other channel of the first pair. The first and second pair of C-shaped channels are positioned so as to preferably obtain a relatively high Free Area percentage while still maintaining strict ballistic resistance and forced entry standards.

18 Claims, 5 Drawing Figures

BALLISTIC AND FORCED ENTRY RESISTANT BARRIER

BACKGROUND OF THE INVENTION

1. Technical Field

The present invention relates to barriers which allow air to flow from one side of the barrier to the other while inhibiting the passage of solid objects therethrough. More particularly, the present invention relates to ballistic and forced entry resistant barriers.

2. Background Information

Many applications exist where adequate ventilation of an enclosed area is imperative while maintaining a relatively high degree of forced entry and ballistic resistant integrity. For example, in security installations having a power substation or generator, it is important to provide adequate ventilation of the enclosed power source while minimizing the chances of successfully sabotaging the power source by access through the ventilation means.

The typical method of indicating ventilation efficiency is by reference to the percent Free Area, as defined by the Air Movement and Control Association (AMCA) Standard 500-83. Percent Free Area is the minimum cumulative open pathway area divided by the total area of barrier surface facing the air flow. While percent Free Area exhibited by architectural quality louvers (i.e., non ballistic) are typically 40 to 50 percent, the prior art ballistic barriers typically can achieve no more than about 20 to 33 percent Free Area, with many types only exhibiting about 50 to 10 percent Free Area.

Various configurations for bulletproof barriers are known in the art. For example, U.S. Pat. No. 1,953,708 issued to Fuller discloses a bulletproof structure for use in bank teller cages. In Fuller, the bulletproof barrier comprises a top portion of clear bulletproof glass and a bottom portion of bulletproof steel channels arranged in a staggered layer arrangement. The top portion includes means for ventilation which comprises two sheet of bulletproof glass, each sheet having openings which allow for ventilation. The openings are staggered with respect to each other so that a projectile cannot make its way through both openings. The Free Area area of the Fuller barrier is about 30%.

Other bulletproof barriers for bank tellers are also known, such as the baffle arrangement shown in U.S. Pat. No. 3,749,028 issued to Strobl. Strobl discloses a bulletproof baffle for positioning within a communication opening in a bulletproof window. The baffle has an X-shaped cross-section permitting the passage of sound waves but obstructing straight line axis for a bullet or the like. A major drawback to Strobl is that bullets are able to ricochet off the X-shaped cross-section, causing possible harm to one on the other side of the barrier. Additionally, Strobl has a very low Free Area range of about 15 to 25%.

One of the biggest problems with conventional prior art bulletproof structures is their lack of adequate ventilation channels. As stated previously, conventional ballistic barriers have a Free Area range between 20 to 33%. For comparison, typical prior art louvers which are not designed for ballistic protection tend towards a 40 to 50% Free Area range. Due to the relatively low Free Area ranges of conventional ballistic barriers, alternative ventilation systems are required for increased ventilation. Several ventilation system configurations are known in the art. For example, U.S. Pat. No. 1,218,684 issued to Mitchell discloses a ventilation device for a transom above a doorway. The device comprises two sets of staggered C-shaped plates which are movable relative to each other to permit an adjustable range of ventilation. Although Mitchell allows variable ventilation, the system is far from bulletproof, for the C-shaped plates allow projectiles a direct access through the ventilation system.

However, other venitlation systems have been developed which do not allow direct access through the ventilation system. For example, U.S. Pat. No. 2,424,219 issued to Black eliminates any direct access by a complex series of vanes and troughs designed to prevent sand, dust, and the like from passing through the ventilation means. Black's system has a Free Area of only about 25%. In addition, U.S. Pat. No. 547,356 issued to Pancoast discloses a system with two rows of C-shaped channels diametrically opposed so that their concave sides face each other. The channels are staggered so that a direct line of sight is eliminated.

The biggest drawback to incorporating an alternative and supplemental ventilation system is that of increased security risks. It may not be feasible to incorporate a supplemental ventilation system in the security area for reasons such as the unacceptable increase in security risks, additional costs, area constraints, undesired system complexity, or the like.

SUMMARY OF THE INVENTION

Accordingly, it is an object of the present invention to provide a forced entry and ballistic resistant barrier which has the Free Area characteristics of non-ballistic resistant louvers.

It is a further object of the present invention to provide a barrier which is certified to the United States Department of State standards of RIFLE STANDARD for ballistic resistance (SD-STD-01.02 REV D (May, 1983)) and PROLONGED forced entry (SD-STD-01.01 REV D (May, 1983).

The present invention is directed to a certified forced entry and ballistic resistant barrier which has the Free Area characteristics of non-ballistic resistant louvers. The barrier comprises a plurality of adjacent segments securely and rigidly affixed to each other. Each segment includes a first pair of longitudinally elongated C-shaped channels whose concave sides are diametrically opposed. A longitudinally elongated flat bar is positioned between the first pair of C-shaped channels such that one C-shaped channel overlaps an end portion of the width of the flat bar, while the other C-shaped channel overlaps another end portion of the width of the flat bar. There is also a center portion of the flat bar which is not overlapped by either of the C-shaped channels. This nonoverlapped portion ensures that the first pair of C-shaped channels are not in contact with each other and thus ventilation is provided by allowing air to flow from one side of the sigment to the other side.

The first pair of C-shaped channels and flat bar are ridigly positioned by a positioning plate having a pair of C-shaped slots and a rectangular slot, corresponding to the shape and relative positions of the C-shaped channels and flat bar, respectively. In the preferred embodiment, a plurality of positioning plates are symmetrically located along the segments longitudinal axis, increasing segment rigidity and structural integrity.

In addition to the first pair of C-shaped channels, each segment comprises a second pair of longitudinally elongated C-shaped channels. The second pair of channels are larger than the first pair and are positioned cocentrically about the first pair such that one channel of the second pair overlaps a convex portion of one channel of the first pair; the other channel of the second pair overlaps a complementary covex portion of the other channel of the first pair. This second pair of channels yields increased Free Area characteristics from one side of the segment to the other side, in addition to increasing the segments' security integrity. The second pair of C-shaped channels are rigidly positioned by being affixed to the circumference of the positioning plates which hold the first pair of C-shaped channels and the flat bar.

The forced entry and ballistic resistant barrier of the present invention comprises a plurality of adjacent segments securely and rigidly affixed to each other. The adjacent segments are secured to each other by screws which run from one outer C-shaped channnel to its adjacent C-shaped channel. To inhibit any attempts to separate the barrier by cutting the screws between segments, an elongated mullion, running the longitudinal axis of each segment, is attached to each pair of adjacent segments covering their abutment surface at least on the attack side of the barrier.

An optional mesh screen is attached to one side of each segment for inhibiting solid objects, such as shell fragments or other forms of shrapnel, from passing through the barrier.

DESCRIPTION OF THE PREFERRED EMBODIMENTS

Figure 1:
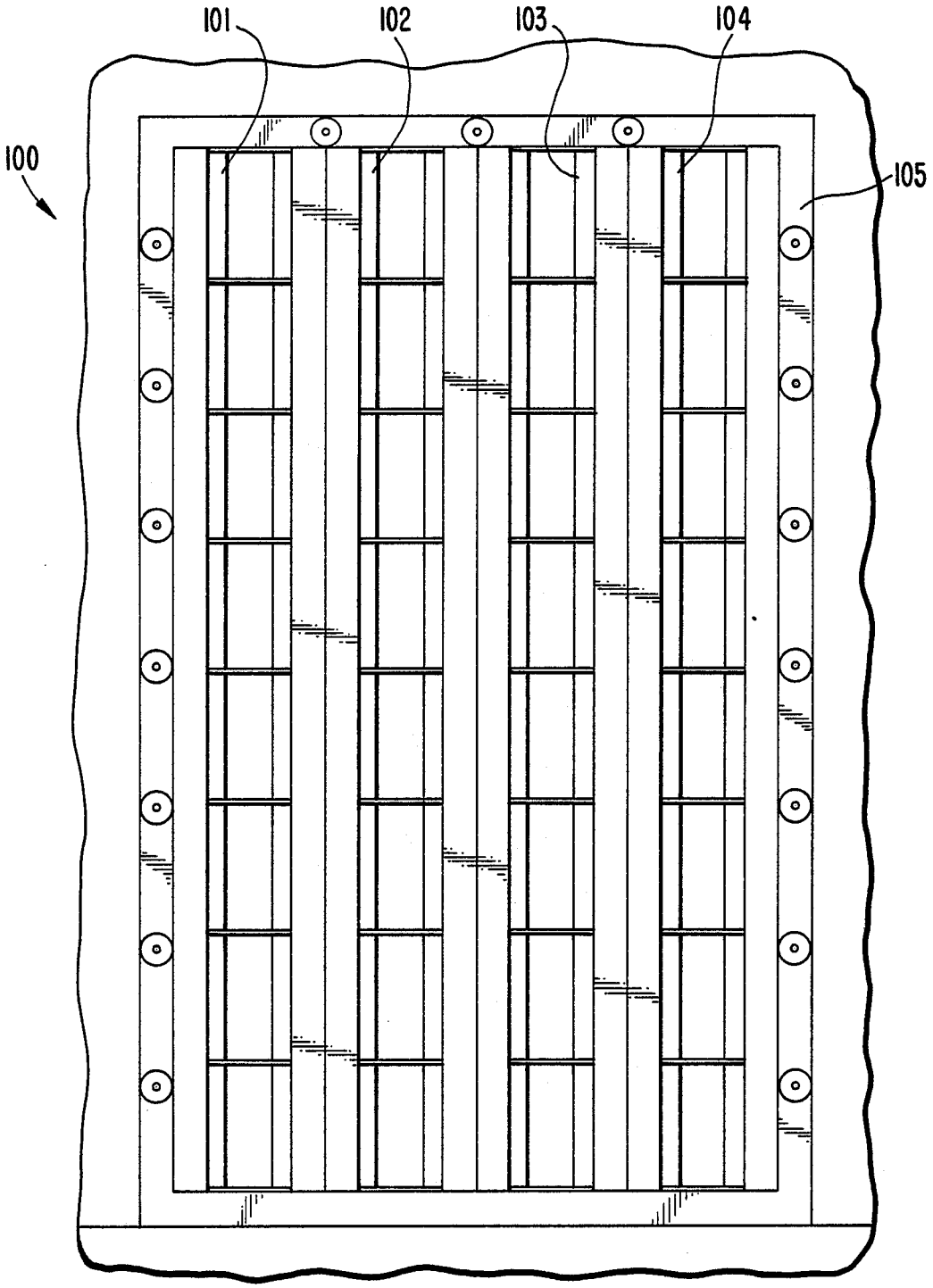
FIG. 1 is a front view of the forced entry and ballistic resistant barrier of the present invention.

Turning now to FIG. 1, the forced entry and ballistic resistant barrier of the present invention is shown. Barrier 100 is shown with four segments 101, 102, 103 and 104, described below with reference to FIGS. 2 through 5.

Barrier 100 can be any longitudinal length, and can consist of any number of segments 101–104. In the illustrated embodiment, barrier 100 comprises four segments whose longitudinal length corresponds to a door.

Figure 2:
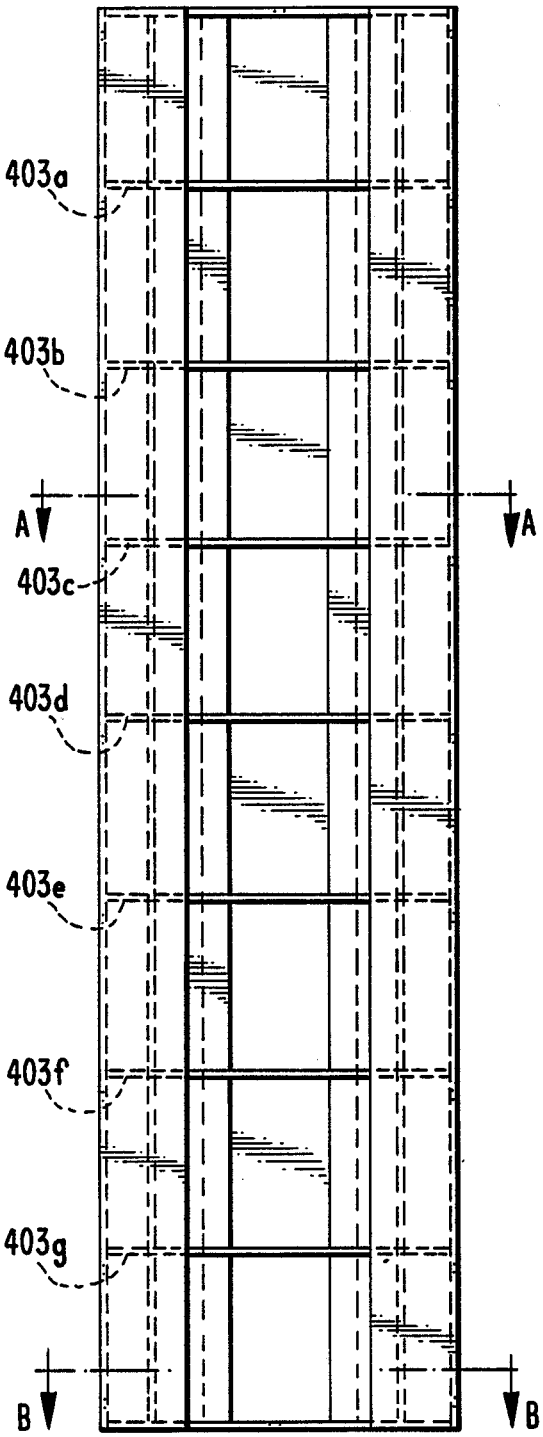
FIG. 2 is a front view of a segment of the barrier of the present invention.
Figure 3:
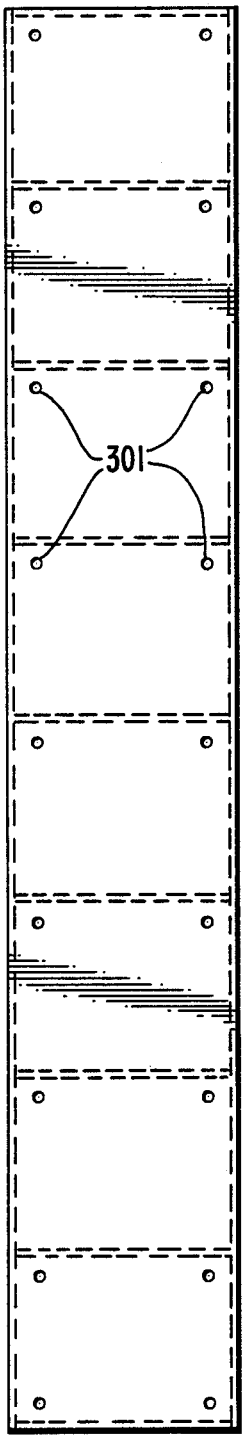
FIG. 3 is a side view of the segment of the barrier of the present invention.
Figure 4:
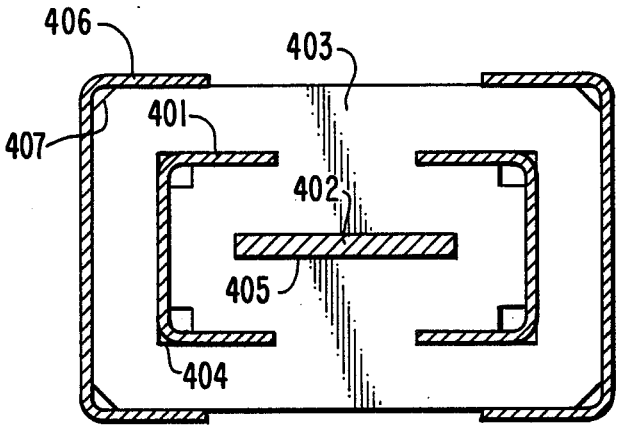
FIG. 4 is a sectional view of the segment shown in FIG. 2 taken at lines A—A.

FIGS. 2 and 3 are the front and side views, respectively, of any of the identical segments shown in FIG. 1. Cross-section A—A best shows the segments's construction, and is illustrated in FIG. 4. Turning now to FIG. 4, each segment comprises a first pair of longitudinally elongated C-shaped channels 401 whose concave sides are diametrically opposd. A longitudinally elongated flat bar 402 is positioned therebetween such that air can flow through the segment.

Channels 401 and flat bar 402 are rigidly positioned by positioning plate 403. Channels 401 and bar 402 fit into slots 404 and 405, respectively. Slot 404 includes squared corners to facilitate tolerance variations in channel 401. In the preferred embodiment, each segment includes a plurality of positioning plates 403 symmetrically located along the segment's longitudinal axis, shown in FIG. 2 as 403*a* through 403*g*.

Returning to FIG. 4, each segment also includes a second pair of C-shaped channels 406, which is larger than the first pair of channels 401. The second pair of channels are positioned concentrically about the outside of the first pair such that only a convex portion of the first pair are overlapped. In this way, increased circulation of air from one side of the segment to the other is obtained. Channels 406 attach to positioning plate 403 on the plate's circumference. Plate 403 also includes corner cutoffs 407 to facilitate tolerance variations in channels 406.

The barrier comprises a plurality of adjacent segments securely and rigidly affixed to each other. The adjacent segments are secured to each other in the preferred embodiment by break-off security machine screws (not shown) through holes 301 shown in FIG. 3. To inhibit any attempts at separating the barrier segments by filing the screws between the segments, an elongated mullion (not shown), running the longitudinal length of the segments, is attached to each pair of adjacent segments covering their abutment surface. Although these mullions need only cover the segments on the barrier side facing a possible attack, the preferred embodiment includes these mullions on both sides of the barrier.

Figure 5:
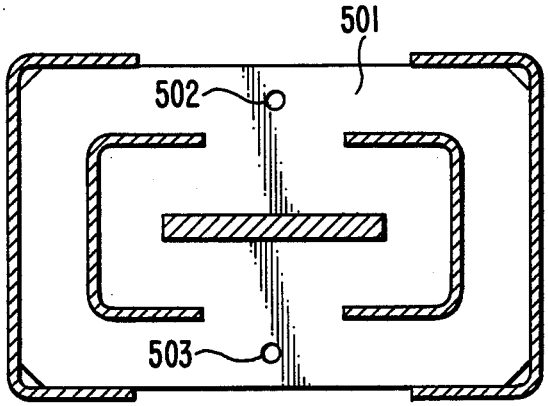
FIG. 5 is a sectional view of the segment shown in FIG. 2 taken at lines B—B.

The barrier can be mounted in any suitable fashion, such as directly attached to a wall structure or to an independent frame. As illustrated, the barrier attaches to frame 105 (FIG. 1) by top and bottom plates shown at cross-section B—B of FIG. 2 to form a movable door. The top and bottom plates are identical, and FIG. 5 shows bottom plate 501 having holes 502 and 503 for securing each segment to the top or bottom member of frame 105 (FIG. 1). The outer segments attach to frame 105 by screws via holes 301 (FIG. 3).

In case of attack, an optional mesh screen is attached to the non-attack side of each segment. The mesh screen in preferably No. 12 stainless steel mesh. Although any mesh size and material type can be used, stainless steel is preferred. Its energy absorption characteristics have been found to be superior in inhibiting solid objects, such as shell fragments or shrapnel, from passing through the barrier due to ricochet or spray.

In the preferred embodiment, each segment is made of carbon steel. The flat bar 402 is $\frac{3}{4}$ inch by about 5 inches. The first pair of C-shaped channels 401 is $\frac{1}{4}$ inch by about 8.7 inches and bent such that its bends are about $2\frac{5}{8}$ inches in length. The second pair of C-shaped channels 406 is $\frac{1}{4}$ inch by about 12.7 inches and bent such that its bends are about $2\frac{7}{8}$ inches in length. The first and second pair of C-shaped channels are positioned relative to the flat bar to give a free air range of between 35–50%. Preferably, the free air range is between 40–50%, and most preferably 45–50%. By placing the first pair of channels $1\frac{1}{2}$ inches from the flat bar and the second pair of channels $1\frac{1}{2}$ inches from the first pair, a 45–50% free air range is obtained. The positioning plates 403 and top and bottom plates 501 are $\frac{1}{4}$ inch carbon steel having outside dimensions of about $7\frac{1}{4}$ inches by about $11\frac{1}{2}$ inches, and are symmetrically spaced about the longitudinal axis about every 12 inches. The above dimensions produce a barrier which has been certified to meet the United State Department of State standards of RIFLE STANDARD for ballistic resistance (SD-STD-01.02 REV D (May, 1983)) and PROLONGED forced entry (SD-SDT-01.01 REV D (May, 1983)), as certified by the H.P. White Laboratories, Inc., an independent testing agency.

Although illustrative embodiments of the present invention have been described with reference to the accompanying drawings, it is to be understood that the invention is not limited to those precise embodiments. Various changes and modifications may be affected therein by one skilled in the art without departing from the spirit or scope of the invention.

What is claimed is:

1. A forced entry and ballistic resistant barrier comprising a plurality of attached adjacent segments, each of said segments comprising:

a first pair of longitudinally elongated C-shaped channels positioned so that their concave sides are diametrically opposed;

a longitudinally elongated flat bar positioned between said first pair of C-shaped channels such that a first end portion of the width of said flat bar is surrounded by one of said channels, a second end portion of the width of said flat bar is surrounded by the other of said channels, and a central portion of the width of said flat bar which is not surrounded by either of said channels, thereby allowing the circulation of air from one side of said flat bar to the opposite side while prohibiting the passage of projectiles from one side to the other;

positioning means for rigidly positioning both said first pair of channels in said diametric position and said flat bar between said first pair of channels; and a second pair of longitudinally elongated C-shaped channels concentrically positioned about said first pair of C-shaped channels such that one channel of said second pair overlaps a convex portion of one channel of said first pair, and the other channel of said second pair overlaps a complementary convex portion of the other channel of said first pair, thereby allowing increased circulation of air from one side of said segment to the other, wherein said second pair of channels are rigidly positioned by said positioning means.

2. The barrier of claim 1 wherein said positioning means includes a plurality of positioning plates positioned symmetrically about the longitudinal axis of each of said segments.

3. The barrier of claim 1 having a Free Area range between 35 and 50 percent.

4. The barrier of claim 2 wherein each of said positioning plates have a pair of diametrically opposed C-shaped slots and a rectangular slot positioned therebetween for allowing said first pair of C-shaped channels and said flat bar to be inserted respectively therein for rigid positioning thereof.

5. The barrier of claim 4 further comprising:

securing means for securedly attaching said plurality of adjacent segments such that one of said second pair of channels of one segment abuts another of said second pair of channels of another adjacent segment.

6. The barrier of claim 5 wherein said securing means includes break-off security machine screws securely attaching the abutting surfaces of adjacent segments.

7. The barrier of claim 6 wherein said securing means further includes first elongated mullions securedly attached to each of said abutting segments so as to cover the point of abutment on one side of said barrier.

8. The barrier of claim 7 wherein said securing means further includes second elongated mullions securedly attached to each of said abutting segments so as to cover the point of abutment on the other side of said barrier.

9. The barrier of claim 5 wherein each of said segments further comprise:

a mesh screen securely attached to one side of said segment for allowing the passage of air through said segment while inhibiting the passage of solid object therethrough.

10. The barrier of claim 9 wherein said mesh screen is of material comprising stainless steel.

11. The barrier of claim 3 having a Free Area range between about 40 and 50 percent.

12. The barrier of claim 11 having a Free Area range between about 45 and 50 percent.

13. The barrier of claim 4 wherein each of said positioning plates also has a peripheral surface, a portion of the concave side of each of said second pair of channels being ridigly affixed to a portion of the periphery of said positioning plates.

14. The barrier of claim 13 wherein said first and said second pair of C-shaped channels and said elongated flat bar are positioned such that the Free Area range is between about 35 and 50 percent.

15. The barrier of claim 14 wherein said Free Area range is between about 40 and 50 percent.

16. The barrier of claim 15 wherein said Free Area range is between about 45 and 50 percent.

17. The barrier of claim 4 wherein each of said segments further comprise a mesh screen securely attached to one side of said segment for allowing the passage of air through said segment while inhibiting the passage of solid objects therethrough.

18. The barrier of claim 17 wherein said mesh screen is of a material comprising stainless steel.

* * * * *